US011219346B2

(12) United States Patent
Kang et al.

(10) Patent No.: US 11,219,346 B2
(45) Date of Patent: Jan. 11, 2022

(54) ROBOT CLEANER

(71) Applicant: LG Electronics Inc., Seoul (KR)

(72) Inventors: Hyemin Kang, Seoul (KR); Sangik Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 241 days.

(21) Appl. No.: 16/481,153

(22) PCT Filed: Jan. 30, 2018

(86) PCT No.: PCT/KR2018/001255
§ 371 (c)(1),
(2) Date: Jul. 26, 2019

(87) PCT Pub. No.: WO2018/143635
PCT Pub. Date: Aug. 9, 2018

(65) Prior Publication Data

US 2021/0127928 A1 May 6, 2021

(30) Foreign Application Priority Data

Feb. 1, 2017 (KR) ..... 10-2017-0014512

(51) Int. Cl.
*A47L 9/24* (2006.01)
*A47L 5/22* (2006.01)
(Continued)

(52) U.S. Cl.
CPC ..... *A47L 9/242* (2013.01); *A47L 5/225* (2013.01); *A47L 9/0673* (2013.01); *A47L 9/2805* (2013.01); *A47L 2201/06* (2013.01)

(58) Field of Classification Search
CPC ..... A47L 9/242; A47L 5/225; A47L 9/0673; A47L 9/2805; A47L 2201/06
See application file for complete search history.

(56) References Cited

U.S. PATENT DOCUMENTS 8,713,748 B2 * 5/2014 Yoon ..... A47L 9/242 15/319
2012/0000030 A1 * 1/2012 Conrad ..... A47L 5/28 15/329
(Continued)

FOREIGN PATENT DOCUMENTS

JP 05211967 A * 8/1993 ..... A47L 9/009
JP 2750036 B2 2/1998
(Continued)

OTHER PUBLICATIONS

KR-101253639-B1—English Machine Translation (Year: 2013).*
(Continued)

*Primary Examiner* — Marc Carlson
(74) *Attorney, Agent, or Firm* — Finnegan, Henderson, Farabow, Garrett & Dunner, LLP

(57) ABSTRACT

A robot cleaner includes a cleaner main body including a first connection duct, and a cleaning module including a second connection duct detachably coupled to the first connection duct to perform a dust suction function or a mopping function. The first and second connection ducts include a first facing surface and a second facing surface, respectively. The first and second facing surfaces face each other when the cleaning module is coupled to the cleaner main body. The first and second facing surfaces are formed in an annular shape to surround flow paths of the first and second connection ducts, respectively, and the first and second facing surfaces include a first terminal portion and a second terminal portion, respectively, which are attached to each other by a magnetic force.

13 Claims, 9 Drawing Sheets

(51) Int. Cl.
*A47L 9/06* (2006.01)
*A47L 9/28* (2006.01)

(56) References Cited

U.S. PATENT DOCUMENTS

| | | | | |
|---|---|---|---|---|
| 2014/0237755 | A1* | 8/2014 | Conrad | A47L 9/327 15/329 |
| 2015/0208891 | A1* | 7/2015 | Jang | A47L 5/225 15/319 |
| 2017/0273529 | A1* | 9/2017 | Chung | A47L 5/362 |
| 2018/0184870 | A1* | 7/2018 | Moon | A47L 11/282 |
| 2019/0142234 | A1* | 5/2019 | Yoon | G05D 1/0238 701/23 |
| 2019/0223676 | A1* | 7/2019 | Jang | A47L 11/34 |
| 2020/0093342 | A1* | 3/2020 | Jeong | H01M 10/46 |
| 2020/0323413 | A1* | 10/2020 | Li | A47L 11/4072 |
| 2020/0383549 | A1* | 12/2020 | Weigel | A47L 11/4075 |
| 2021/0022572 | A1* | 1/2021 | Saur | A47L 9/242 |

FOREIGN PATENT DOCUMENTS

| | | | |
|---|---|---|---|
| KR | 20-1994-0014555 | | 7/1994 |
| KR | 2019950000270 | | 1/1995 |
| KR | 20-0342505 | | 2/2004 |
| KR | 20-0379429 | | 3/2005 |
| KR | 10-2007-0099763 | | 10/2007 |
| KR | 10-1253639 | B1 | 4/2013 |
| KR | 101253639 | B1 * | 4/2013 |
| KR | 10-2015-0081767 | A | 7/2015 |

OTHER PUBLICATIONS

Notice of Allowance dated Jan. 22, 2019 of Korean Application No. 10-2017-0014512.

Search Report of EP Application No. 18747747.6 dated Feb. 26, 2021.

* cited by examiner

ROBOT CLEANER

CROSS-REFERENCE TO RELATED APPLICATIONS

This application is a U.S. National Phase entry under 35 U.S.C. § 371 from PCT International Application No. PCT/KR2018/001255, filed Jan. 30, 2018, which claims the benefit of priority of Korean Patent Application No. 10-2017-0014512, filed Feb. 1, 2017, the entire contents of all of which are incorporated herein by reference in their entireties.

BACKGROUND

Field

The present invention relates to a robot cleaner in which a cleaning module is detachably coupled to a cleaner main body.

Description of Related Art

In general, robots have been developed for industrial use and have been part of factory automation. In recent years, the field of applications of robots has been expanded, and home robots that can be used in ordinary homes as well as aerospace robots and medical robots have been made.

A representative example of a home robot may be a robot cleaner. The robot cleaner carries out a function of cleaning a floor while traveling in a predetermined area by itself. To this end, the robot cleaner includes a driving wheel, a sensing unit, and a cleaning module for sucking dust and foreign materials from the floor or mopping the floor.

In recent years, a cleaner (for example, a canister-type vacuum cleaner) requiring a user's operation has been provided with an automatic operation function. As an example of the automatic operation function, a kind of robot cleaner which follows a user (strictly speaking, an extension unit operated by the user) by itself even without the user pulling the cleaner main body.

The cleaner differs from a typical robot cleaner in the aspect of further employing the extension unit for connecting the cleaner main body and the cleaning module to each other, but is considerably similar to the typical robot cleaner in the aspect of including a driving wheel, a sensing unit, and a cleaning module.

Therefore, if the cleaning module of the robot cleaner is configured to be detachable from the cleaner main body and the extension unit is connectable between the cleaner main body and the cleaning module, the robot cleaner may be configured in different forms according to an assembly type. That is, the cleaner may be configured as the typical robot cleaner when the cleaning module is mounted to the cleaner main body, whereas the cleaner may be configured as a cleaner operated by the user when the extension unit is connected between the cleaner main body and the cleaning module.

However, in the related art, the cleaning module is coupled to the cleaner main body by a mechanical coupling structure such as a hook, which is inconvenient for the user to detach the cleaning module from the cleaner main body. Particularly, since a connection portion with the cleaning module is located at a lower portion of the cleaner main body, the user has to attach or separate the cleaning module with bending his/her upper body.

Accordingly, in order for the robot cleaner to be used in the various forms as described above, a new connection structure that facilitates detachment between the cleaner main body and the cleaning module should be preceded. The present invention is directed to providing a new detachable structure between the cleaner main body and the cleaning module by using the principle of the invention titled "Connector using magnet" disclosed in Korean Patent Publication No. 10-2016-0061013 (opened on May 31, 2016).

SUMMARY

Technical Problem

A first aspect of the present disclosure is to provide a robot cleaner including a cleaning module configured to be detachably coupled to a cleaner main body without a mechanical coupling structure such as a hook or the like.

A second aspect of the present disclosure is to provide a structure capable of preventing a cleaning module from being inserted into a cleaner main body in a wrong direction.

A third aspect of the present disclosure is to provide a robot cleaner, configured to distinguish between an attachment of a cleaning module and an attachment of an extension unit to a cleaner main body, so as to operate in a different cleaning mode depending on whether the cleaning module or the extension unit is attached to the cleaner main body.

Technical Solution

To achieve the first aspect of the present disclosure, a robot cleaner according to an embodiment may include a cleaner main body provided with a first connection duct, and a cleaning module provided with a second connection duct configured to be detachably coupled to the first connection duct to perform a dust suction function or a mopping function. The first and second connection ducts may each include a first facing surface and a second facing surface, respectively, which face each other when the cleaning module is coupled to the cleaner main body. The first and second facing surfaces may be formed in an annular shape to surround flow paths of the first and second connection ducts, respectively. The first and second facing surfaces may include a first terminal portion and a second terminal portion, respectively, which are attached to each other by magnetic force.

The flow path of the first connection duct and the flow path of the second connection duct may communicate with each other in a state where the first and second terminal portions are attached to each other.

The first connection duct may further include an accommodating portion extending forward from the first facing surface to surround an outer circumference of the second connection duct.

The first and second facing surfaces may be closely adhered to each other in the state where the first and second terminal portions are attached to each other.

One of the first and second facing surfaces may be provided with a sealing member closely adhered on a facing surface of the other of the first and second facing surfaces in the state where the first and second terminal portions are attached to each other, thus separating the first and second terminal portions from the flow paths of the first and second connection ducts.

One of the first and second terminal portions may protrude from one facing surface. A facing surface of the other of the first and second terminal portions may include a recess in which the one terminal portion is inserted. The other of the first and second terminal portions may form a bottom surface of the recess.

The first aspect of the present disclosure may be achieved by a robot cleaner, which may include a cleaner main body including a first connection duct, and a cleaning module including a second connection duct detachably coupled to the first connection duct to perform a dust suction function or a mopping function. The second connection duct may be detachably coupled to the first connection duct by magnetic force. A second terminal portion of the second connection duct may be connected to a first terminal portion of the first connection duct and a flow path of the first connection duct and a flow path of the second connection duct may communicate with each other in a state where the second connection duct is attached to the first connection duct.

The first terminal portion and the second terminal portion may have externally-exposed front portions configured as magnets having opposite polarities to each other so as to be attached to each other by a magnetic attractive force when the first and second connection ducts are disposed adjacent to each other.

The first and second connection ducts may be provided with a first facing surface and a second facing surface, respectively, which face each other when the cleaning module is attached to the cleaner main body. The first and second facing surfaces may each be formed in an annular shape to surround the flow paths of the first and second connection ducts, respectively. The first and second facing surfaces may each be provided with the first and second terminal portions, respectively.

In order to achieve the second aspect of the present disclosure, the accommodating portion may be formed to be asymmetric up and down.

The first terminal portion may be provided with a first electrode and a second electrode spaced apart from each other and having front portions exposed to the first facing surface, the front portions having opposite polarities to each other. The second terminal portion may be provided with a first counter electrode and a second counter electrode arranged to correspond to the first and second electrodes, respectively.

The first terminal portion may be further provided with a third electrode and a fourth electrode disposed at positions symmetrical with the first and second electrodes with respect to a center of the first connection duct, and having front portions exposed to the first facing surface, the front portions having opposite polarities to those of the first and second electrodes. The second terminal portion may be further provided with a third counter electrode and a fourth counter electrode disposed at positions symmetrical with the first and second counter electrodes, respectively, with respect to a center of the second connection duct, and having front end portions exposed to the second facing surface, the front portions having opposite polarities to those of the first and second counter electrodes.

The second connection duct may be further provided with a weight disposed between the third counter electrode and the fourth counter electrode.

A settling groove may be formed on an outer circumference of the second connection duct located at an opposite side to the weight with respect to a center of the second connection duct.

In order to achieve the third aspect of the present invention, the robot cleaner may further include an extension unit having opposite end portions connected to the first and second connection ducts, respectively, in a state where the second connection duct is separated from the first connection duct. One end portion of the extension unit connected to the first connection duct may be provided with a permanent magnet, and the first connection duct may be provided with a hall sensor to detect a change in magnetic force caused by the permanent magnet.

A controller of the cleaner main body may activate a different cleaning mode according to presence or absence of a detected magnetic force using the hall sensor.

In addition, the connection structure between the cleaning module and the cleaner main body can be directly applied to the connection structure between the extension unit and the cleaner main body.

For example, a robot cleaner according to the present invention may include a cleaner main body provided with a first connection duct, a cleaning module provided with a second connection duct to perform a dust suction function or a mopping function, and an extension unit having opposite end portions connected to the first and second connection ducts, respectively. The extension unit may be detachably coupled to the first connection duct by magnetic force. A terminal portion of the extension unit may be connected to a terminal portion of the first connection duct and a flow path of the first connection duct and a flow path of the extension unit may communicate with each other, in a state where the extension unit is attached to the first connection duct.

As another example, a robot cleaner according to the present disclosure may include a cleaner main body including a first connection duct, a cleaning module including a second connection duct to perform a dust suction function or a mopping function, and an extension unit having opposite end portions connected to the first and second connection ducts, respectively. The first connection duct and one end portion of the extension unit connected to each other may be provided with a first facing surface and a second facing surface, respectively, which face each other when the extension unit is coupled to the cleaner main body. The first and second facing surfaces may be formed in an annular shape to surround flow paths of the first connection duct and the extension unit. The first and second facing surfaces may be provided with a first terminal portion and a second terminal portion, respectively, attached to each other by magnetic force.

Advantageous Effects

The effects of the present invention obtained by the aforementioned solutions are as follows.

First, according to aspects of the present disclosure, a second terminal portion disposed on a second connection duct of a cleaning module can be attached to a first terminal portion of a first connection duct of a cleaner main body by magnetic force so as to be electrically connected to the first terminal portion, and a flow path of the first connection duct and a flow path of the second connection duct can communicate with each other. Accordingly, operations required for aligning in position the first and second connection ducts for connection therebetween and coupling a mechanical coupling structure such as a hook or the like are not required, thereby improving convenience in detaching the cleaning module from the cleaner main body.

Second, a plurality of electrodes and a plurality of counter electrodes that form a first terminal portion and a second terminal portion can have opposite polarities so as to be attached to each other by magnetic attractive forces, but may repel each other at positions other than precise positions (e.g., vertically-reversed positions), which may result in preventing the cleaning module from being inserted into the cleaner main body in a reverse direction.

The prevention of the reverse insertion may also be achieved by forming in a bilaterally asymmetric form an accommodating portion of a first connection duct for accommodating a second connection duct, providing a weight on a second connection duct, and forming a settling groove on an outer circumference of a second connection duct.

Third, when a second connection duct is separated from a first connection duct and opposite end portions of an extension unit are connected to the first and second connection ducts, respectively, a hall sensor provided on the first connection duct may detect a magnetic force applied by a permanent magnet of the extension unit and a controller may switch a cleaning mode based on the detection result, thereby changing a function of the robot cleaner.

DETAILED DESCRIPTION

Hereinafter, a robot cleaner according to various aspects of the present disclosure will be described in detail with reference to the accompanying drawings.

A singular representation may include a plural representation unless it represents a definitely different meaning from the context.

The same or equivalent components may be provided with the same or similar reference numbers, even in different embodiments, and description thereof will not be repeated.

In describing the present disclosure, if a detailed explanation for a related known function or construction is considered to unnecessarily divert the gist of the present disclosure, such explanation has been omitted but would be understood by those skilled in the art.

The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

Figure 1:
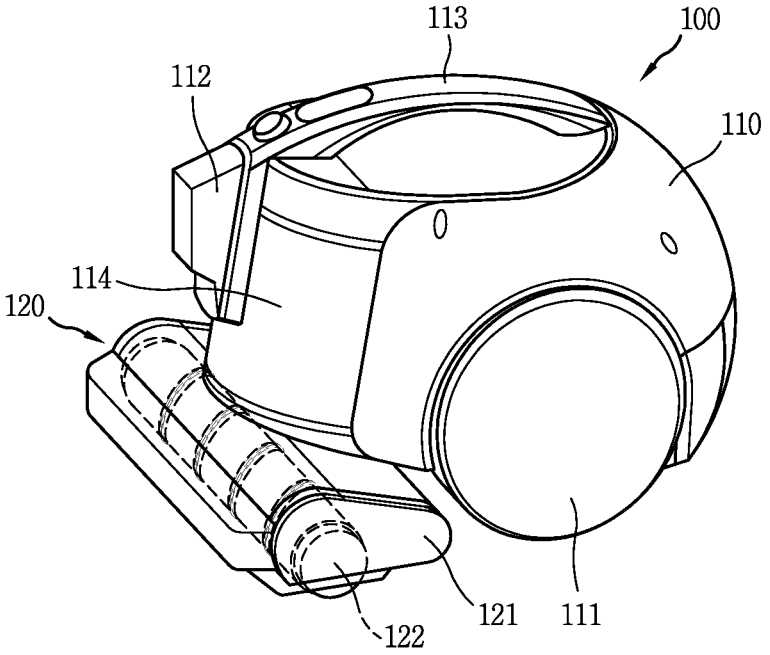
FIG. 1 is a perspective view illustrating one embodiment of a robot cleaner according to the present invention.
Figure 2:
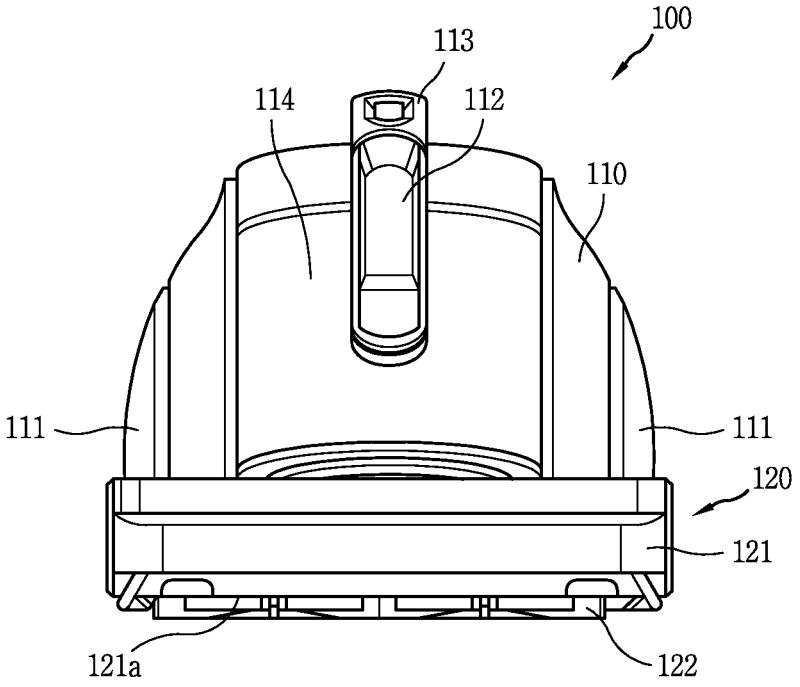
FIG. 2 is a front view of the robot cleaner illustrated in FIG. 1.
Figure 3:
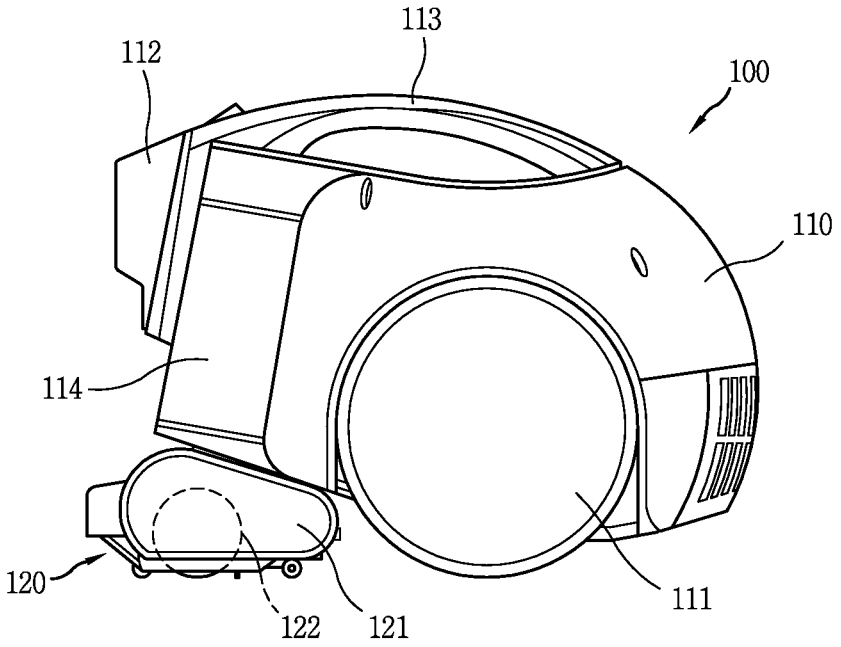
FIG. 3 is a lateral view of the robot cleaner illustrated in FIG. 1.

FIG. 1 is a perspective view illustrating one embodiment of a robot cleaner 100 according to the present invention, FIG. 2 is a front view of the robot cleaner 100 illustrated in FIG. 1, and FIG. 3 is a lateral view of the robot cleaner 100 illustrated in FIG. 1.

These drawings illustrate that the robot cleaner 100 is configured to perform a function of cleaning a floor while traveling on a predetermined area by itself. Cleaning the floor disclosed herein includes sucking dust and foreign materials on the floor or mopping the floor.

Figure 13:
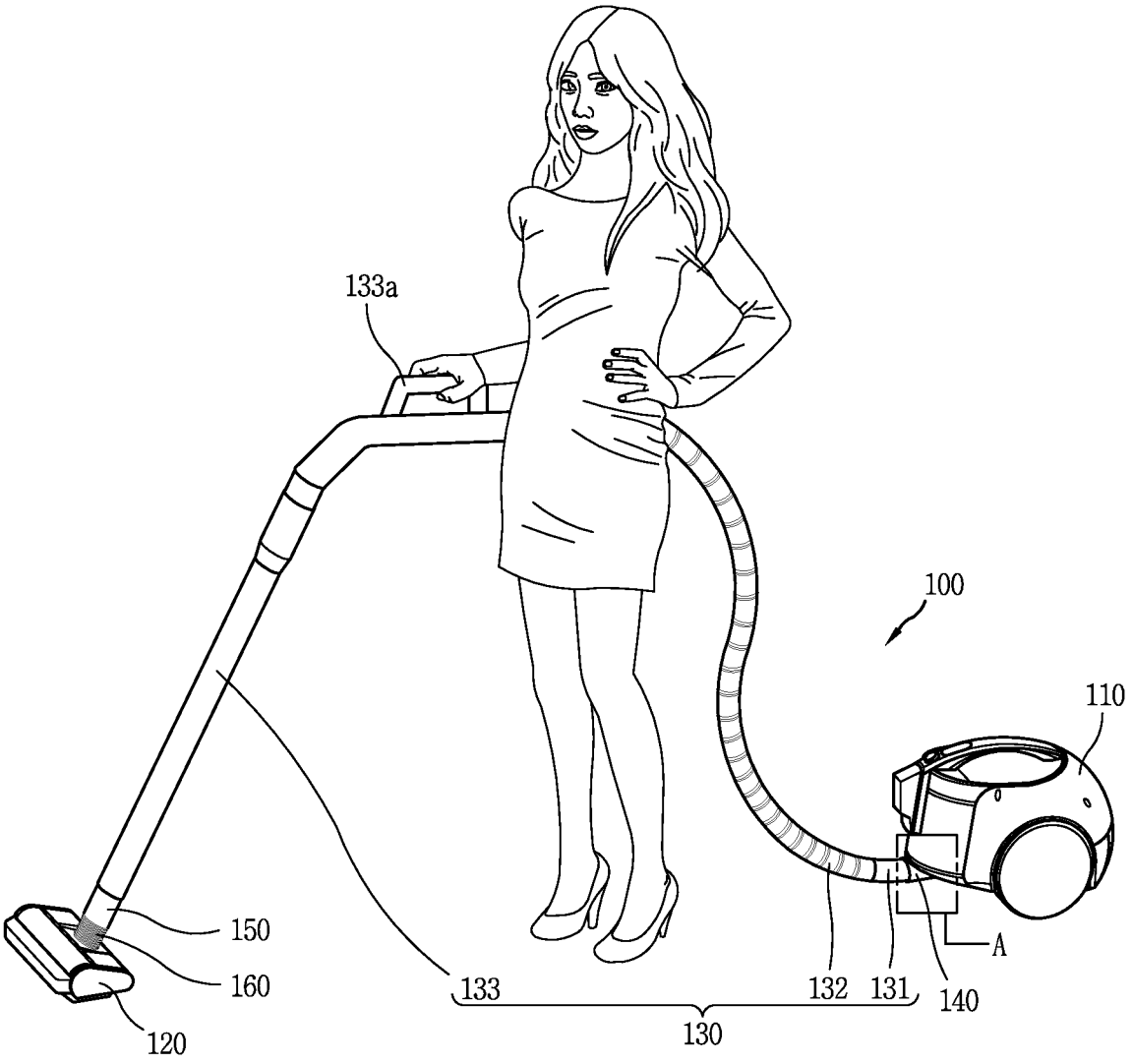
FIG. 13 is a conceptual view illustrating a state in which the cleaning module illustrated in FIG. 1 is detached from the cleaner main body and opposite end portions of the extension unit are connected to the first and second connection ducts, respectively.

For reference, as illustrated in FIG. 13, the robot cleaner 100 according to the present invention may be changed into a type operated by a user, in a manner of mounting an extension unit 130 between a cleaner main body 110 and a cleaning module 120. In this case, the cleaner main body 110 may be configured to move along the extension unit 130 operated by the user or the cleaning module 120 connected to the extension unit 130, without the user pulling the cleaner main body 110.

The robot cleaner 100 includes a cleaner main body 110 and a cleaning module 120.

The cleaner main body 110 is provided with various components in addition to a controller (not illustrated) for controlling the robot cleaner 100.

The cleaner main body 110 is provided with driving wheels 111 for travel. The driving wheels 111 are rotatable by receiving driving force from a driving motor. A rotating direction of the driving motor may be controlled by the controller, and accordingly the driving wheels 111 may be rotatable in one direction or another direction.

The driving wheels 111 may be provided on both left and right sides of the cleaner main body 110, respectively. The cleaner main body 110 may be moved or rotated forward, backward, left or right by the driving wheel 111. Each of the driving wheels 111 may be configured to be driven independently of each other. To this end, each driving wheel 111 may be driven by a different driving motor.

The cleaner main body 110 may be provided with a sensing unit 112 for sensing a surrounding situation of the cleaner main body 110. The controller may sense an obstacle, detect a land feature, or generate a map of a travel area through the sensing unit 112.

The cleaner main body 110 may be provided with a handle 113. The user may lift the cleaner main body 110 by gripping the handle 113 so as to move it to a specific position.

The cleaning module 120 is configured to suck dust and foreign materials from a floor or to mop the floor.

When the cleaning module 120 is configured to suck dust and foreign substances on the floor, a housing 121 constituting appearance of the cleaning module 120 may be provided with an opening 121*a* for sucking air containing dust and foreign materials therethrough. The opening 121*a* may be formed to face the floor.

A brush 122 which is configured to sweep dust on the floor by virtue of rotation of the cleaner main body 110 may be mounted on the opening 121*a*. The brush 122 may be detachably coupled to the opening 121*a*.

The dust and foreign substances in the air sucked through the cleaning module 120 are filtered to be collected in a dust container 114 of the cleaner main body 110. The air separated from the dust and foreign substances is discharged to outside of the cleaner main body 110. The cleaner main body 110 may be provided therein with an intake flow path (not illustrated) through which the air sucked by the cleaning module 120 is guided into the dust container 114, and an exhaust flow path (not illustrated) through which the air passed through the dust container 114 is discharged to the outside of the cleaner main body 110. The dust container 114 may be provided with at least one of a filter and a cyclone for filtering the dust and foreign materials in the sucked air.

When the cleaning module 120 is configured to mop the floor, a mop (not illustrated) may be detachably coupled to the housing 121. The mop may be attached to a lower surface of the housing 121 to mop the floor in response to the movement of the robot cleaner 100. Alternatively, the mop may be mounted to the opening 121*a* in place of the brush 122. In this case, the mop is configured to be rotatable.

The cleaning module 120 may have both a function of sucking dust on the floor and a function of mopping the floor. The user may selectively attach or couple the brush 122 or the mop to the housing 121 according to the cleaning purpose. Alternatively, the brush 122 and the mop may be mounted together on the housing 121 so as to mop the floor after sucking the dust and foreign substances on the floor.

Figure 4:
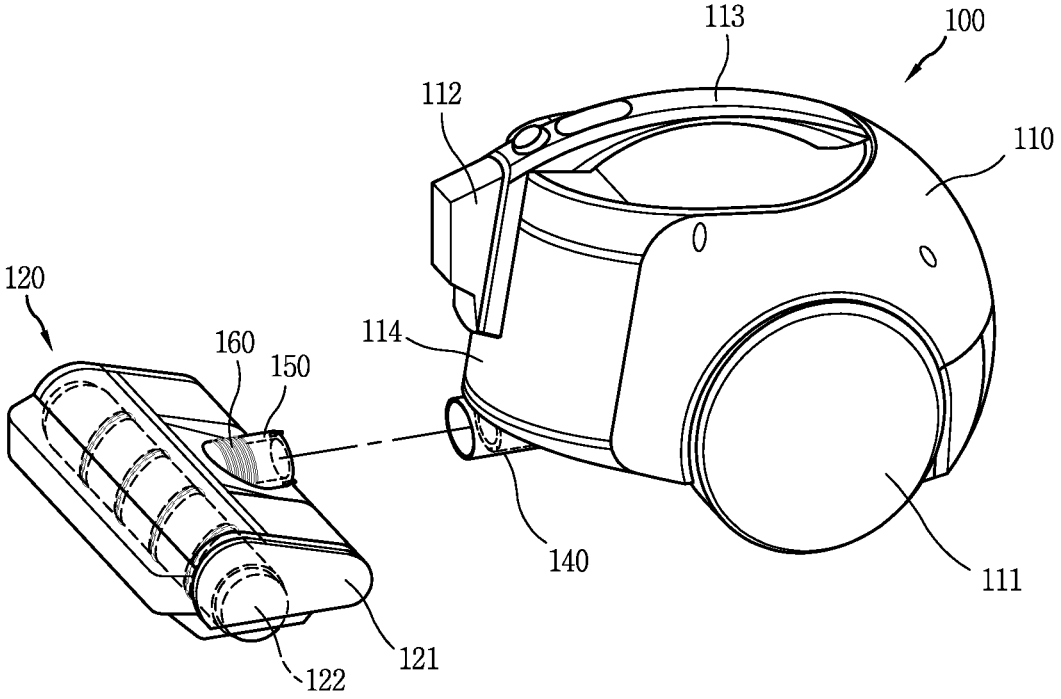
FIG. 4 is a view illustrating a state in which a cleaning module illustrated in FIG. 1 is detached from a cleaner main body.

FIG. 4 is a view illustrating a state in which the cleaning module 120 illustrated in FIG. 1 is detached from the cleaner main body 110.

The cleaning module 120 is detachably coupled to the cleaner main body 110 or the extension unit 130. This embodiment illustrates a state in which the cleaning module 120 is coupled to the cleaner main body 110. For reference, as illustrated in FIG. 13, the cleaning module 120 may also be detachably coupled to the extension unit 130.

If the connection between the cleaner main body 110 and the cleaning module 120 is made by a mechanical coupling structure such as a hook, the user may feel inconvenient in detaching the cleaning module 120 from the cleaner main body 110. Particularly, in order for the robot cleaner 100 to be configured in the form as illustrated in this embodiment or a form as illustrated in FIG. 13, a new connection structure that facilitates the detachment between the cleaner main body 110 and the cleaning module 120 should be preceded.

Hereinafter, description will be given of a structure for facilitating the cleaning module 120 to be detachably coupled to the cleaner main body 110 without a mechanical coupling structure such as a hook.

Figure 5:
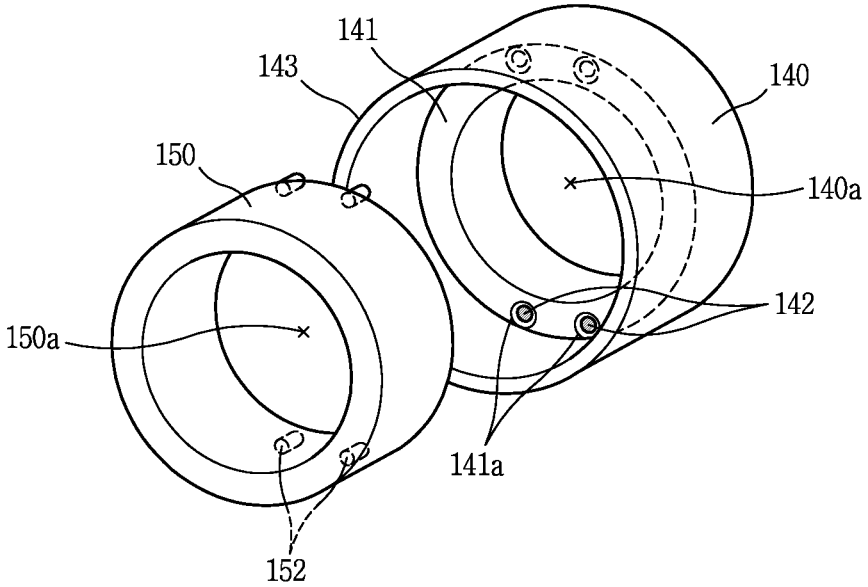
FIG. 5 is a conceptual view illustrating a first connection duct and a second connection duct illustrated in FIG. 4.
Figure 6:
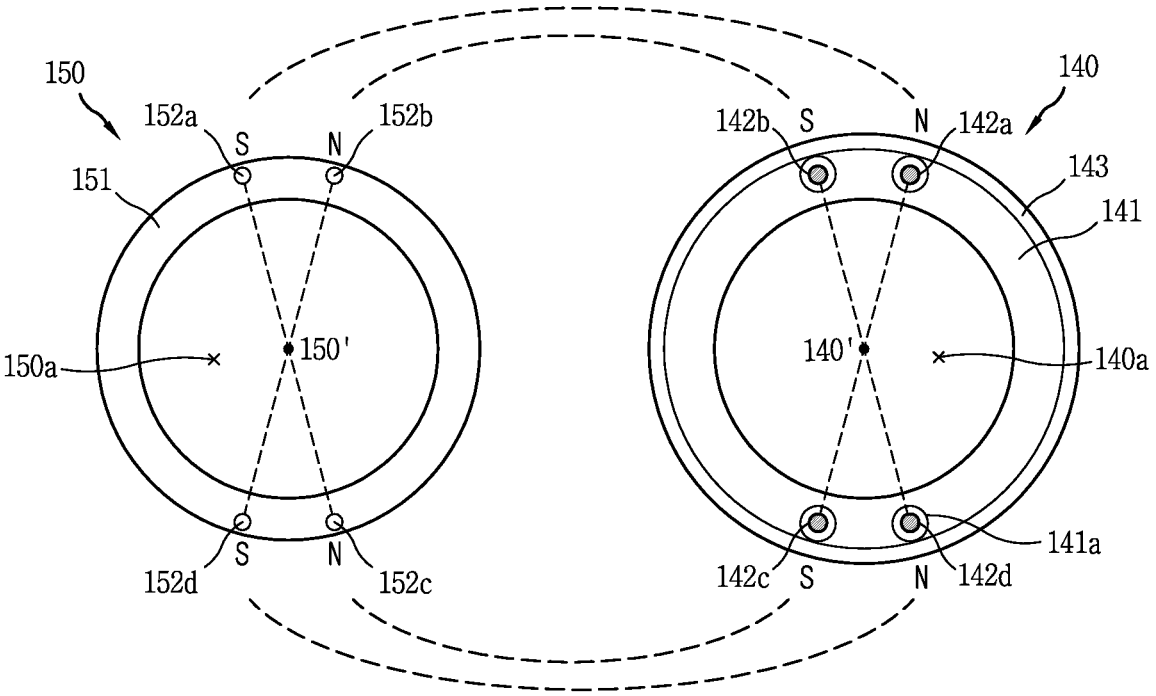
FIG. 6 is a conceptual view illustrating a front surface of the first connection duct and a rear surface of the second connection duct illustrated in FIG. 5.

FIG. 5 is a conceptual view illustrating a first connection duct 140 and a second connection duct 150 illustrated in FIG. 4. FIG. 6 is a schematic view illustrating a front surface of the first connection duct 140 and a rear surface of the second connection duct 150 illustrated in FIG. 5, and FIG. 7 is a sectional view illustrating a state in which the second connection duct 150 illustrated in FIG. 5 is coupled to the first connection duct 140.

Figure 7:
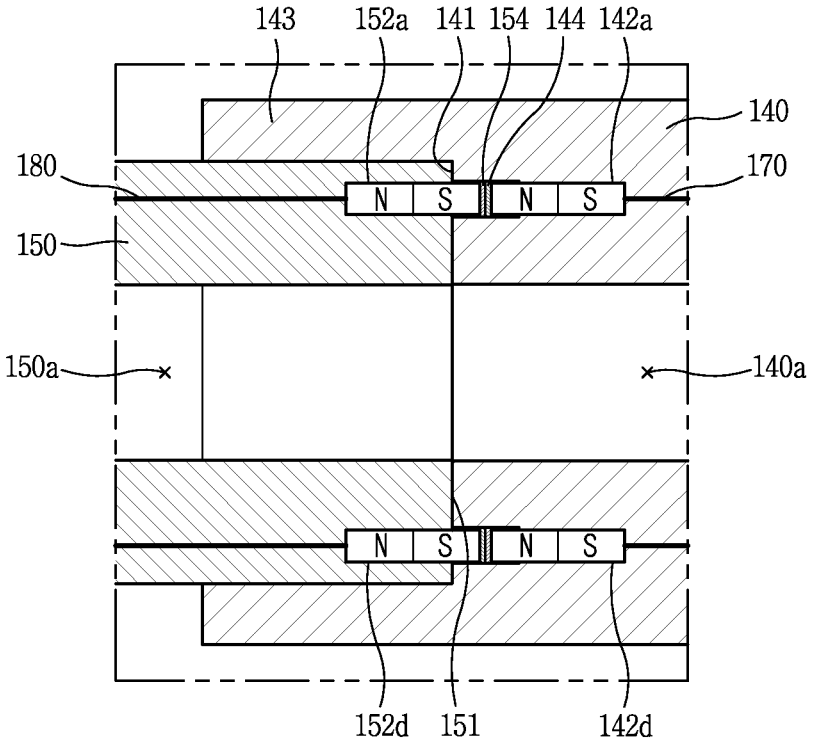
FIG. 7 is a sectional view illustrating a state in which the second connection duct illustrated in FIG. 5 is coupled to the first connection duct.

Referring to FIGS. 5 to 7, the cleaning module 120 is detachably coupled to the cleaner main body 110. To realize the connection between the cleaner main body 110 and the cleaning module 120, the cleaner main body 110 is provided with the first connection duct 140 and the cleaning module 120 is provided with the second connection duct 150 detachably coupled to the first connection duct 140.

The first connection duct 140 is provided on a front surface of the cleaner main body 110. As illustrated, the first connection duct 140 may be disposed on a lower portion of the front surface of the cleaner main body 110.

The first connection duct 140 is provided with a flow path 140*a*. The flow path 140*a* constitutes a front end portion of the intake flow path. The flow path 140*a* is formed to open toward the front of the cleaner main body 110.

The second connection duct 150 is provided on the rear side of the cleaning module 120. The second connection duct 150 may be directly connected to the housing 121 of the cleaning module 120 or may be connected to a flexible bellows 160 connected to the housing 121.

The second connection duct 150 is provided with a flow path 150*a*. The flow path 150*a* communicates with the opening 121*a* through which air is sucked. The flow path 150*a* is formed to be open toward the rear of the cleaning module 120.

The first and second connection ducts 140 and 150 may be formed of a synthetic resin material.

As the second connection duct 150 is coupled to the first connection duct 140, the cleaning module 120 is coupled to the cleaner main body 110. The first and second connection ducts 140 and 150 have a first facing surface 141 and a second facing surface 151, respectively, which face each other when they are coupled to each other.

The first facing surface 141 is formed in an annular shape surrounding the flow path 140*a* of the first connection duct 140 and the second facing surface 151 is formed in an annular shape surrounding the flow path 150*a* of the second connection duct 150. The first and second facing surfaces 141 and 151 may be perpendicular to the flow paths 140*a* and 150*a* of the first and second connection ducts 140 and 150, respectively.

The first and second facing surfaces 141 and 151 are provided with a first terminal portion 142 and a second terminal portion 152, respectively, which are attached to each other by magnetic force (attraction). The connection between the first connection duct 140 and the second connection duct 150 is realized by the attachment between the first terminal portion 142 and the second terminal portion 152.

In the state where the first terminal portion 142 and the second terminal portion 152 are attached to each other, the flow path 140*a* of the first connection duct 140 and the flow path 150*a* of the second connection duct 150 communicate with each other. Accordingly, when the cleaning module 120 is configured to suck dust and foreign substances on the floor, the air sucked through the opening 121*a* formed on the housing 121 of the cleaning module 120 may be introduced into the flow path 140*a* of the first connection duct 140 through the flow path 150*a* of the second connection duct 150.

In order to securely fix the first and second connection ducts 140 and 150, any one of the first and second connection ducts 140 and 150 may be accommodated in the other.

This drawing illustrates an example in which a part of the second connection duct 150 is accommodated in the first connection duct 140. Specifically, the first connection duct 140 is provided with an accommodating portion 143 extending forward from the first facing surface 141 to surround an outer circumference of the second connection duct 150, and a portion of the second connection duct 150 is accommodated in the accommodating portion 143.

This accommodating structure may allow the first and second connection ducts 140 and 150 to be firmly fixed to each other without being detached from each other even though external force of a lateral direction is applied to a connection portion between the first and second connection ducts 140 and 150.

One of the first and second terminal portions 142 and 152 protrudes from a facing surface thereof, so as to be inserted into a recess 141*a* formed on a facing surface of the other one of the first and second terminal portions 142 and 152. The other terminal portion may form a bottom surface of the recess 141*a* so as to be connected to the one terminal portion inserted into the recess 141*a*.

This embodiment illustrates that the second terminal portion 152 protrudes from the second facing surface 151, the first facing surface 141 is provided with the recess 141*a* in which the second terminal portion 152 is inserted, and the first terminal portion 142 forms the bottom surface of the recess 141*a*.

With such connection structure, the first and second terminal portions 142 and 152 can be maintained in a firmly connected state without being detached from each other, even if external force of a lateral direction is applied to the connection portion between the first and second connection ducts 140 and 150.

In the connected state between the first and second terminal portions 142 and 152, the first facing surface 141 and the second facing surface 151 may be closely adhered to each other. As the first facing surface 141 and the second facing surface 151 are brought into surface contact with each other, leakage of air which flows into the flow path 140*a* of the first connection duct 140 through the flow path 150*a* of the second connection duct 140 can be prevented.

The first terminal portion 142 includes a plurality of electrodes 142*a*, 142*b*, 142*c*, and 142*d* spaced apart from one another. The plurality of electrodes 142*a*, 142*b*, 142*c*, and 142*d* are electrically connected to the controller and a power source of the cleaner main body 110 by a wire 170.

The second terminal portion 152 includes a plurality of counter electrodes 152*a*, 152*b*, 152*c*, and 152*d* disposed to correspond to (to be aligned with) the plurality of electrodes 142*a*, 142*b*, 142*c*, and 142*d*. The plurality of counter electrodes 152*a*, 152*b*, 152*c*, and 152*d* are electrically connected to an electronic component of the cleaning module 120 by a wire 180. An example of the electronic component may be a motor that provides rotational driving force to the brush 122.

Polymer layers 144 and 154 for allowing a current flow may be provided on a front end of each electrode 142*a*, 142*b*, 142*c* and 142*d* and a front end of each counter electrode 152*a*, 152*b*, 152*c* and 152*d*. The polymer layers 144 and 154 may be formed in a manner of applying a conductive polymer material or bonding a conductive polymer film. The polymer layers 144 and 154 are configured to prevent permeation of moisture while the current flows.

In this embodiment, the first terminal portion 142 is provided with first and second electrodes 142*a* and 142*b* that are spaced apart from each other. Front portions of the first and second electrodes 142*a* and 142*b*, which are exposed to the first facing surface 141, have opposite polarities.

The second terminal portion 152 is provided with first and second counter electrodes 152*a* and 152*b* disposed to correspond to the first and second electrodes 142*a* and 142*b*, respectively. The first and second counter electrodes 152*a* and 152*b* are spaced apart from each other and front portions thereof, which are exposed to the second facing surface 151, have opposite polarities.

If the first and second connection ducts 140 and 150 are provided respectively on the cleaner main body 110 and the cleaner module 120 in a non-rotatable manner, the second terminal portion 152 may be connected to the first terminal portion 142 merely by an operation of pushing the cleaning module 120 into the cleaner main body 110, such that the second connection duct 150 is coupled to the first connection duct 140. Also, the second terminal portion 152 may be separated from the first terminal portion 142 merely by an operation of pulling the cleaning module 120 from the cleaner main body 110, such that the second connection duct 150 is detached from the first connection duct 140.

Accordingly, operations for aligning the first and second connection ducts 140 and 150 in position for connection therebetween and using a mechanical coupling structure such as a hook or the like are not required, thereby improving convenience in detachment of the cleaning module 120 from the cleaner main body 110.

When at least one of the first and second connection ducts 140 and 150 is rotatable, the first and second terminal portions 142 and 152 may be mis-aligned with each other even though the cleaning module 120 is disposed toward the cleaner main body 110. In some cases, a problem may be caused in which a plurality of counter electrodes are attached to a plurality of electrodes even in a mis-aligned state.

For example, it may be considered that the first and second electrodes 142*a* and 142*b* are arranged to be symmetrical with each other based on a center 140' of the first connection duct 140. When one of the first and second connection ducts 140 and 150 is rotated by 180°, the first electrode 142*a* is disposed to face the second counter electrode 152*b* and the second electrode 142*b* is disposed to face the first counter electrode 152*a*.

In order to prevent an insertion (a kind of erroneous insertion or a reverse insertion) in this arrangement state, the front portions of the first and second electrodes 142*a* and 142*b* exposed to the first facing surface 141 may have opposite polarities to each other. For example, if the front portion of the first electrode 142*a* forms an N pole, the front portion of the second electrode 142*b* may form an S pole. Therefore, front portions of the first and second counter electrodes 152*a* and 152*b* exposed to the second facing surface 151 also have opposite polarities to each other. In the above example, the front portions of the first and second counter electrodes 152*a* and 152*b* form the S and N poles, respectively. Therefore, the first electrode 142*a* is attached only to the first counter electrode 152*a* by attractive force, and is repelled from the second counter electrode 152*b* by repulsive force.

As illustrated, the first terminal portion 142 may further include third and fourth electrodes 142*c* and 142*d*, and accordingly the second terminal portion 152 may also include third and fourth counter electrodes 152*c* and 152*d*.

The third and fourth electrodes 142*c* and 142*d* are formed at positions symmetrical to the first and second electrodes 142*a* and 142*b* based on the center 140' of the first connection duct 140, and front portions thereof exposed to the first facing surface 141 have opposite polarities to those of the first and second electrodes 142*a* and 142*b*, respectively.

The third and fourth counter electrodes 152*c* and 152*d* are formed at positions symmetrical to the first and second counter electrodes 152*a* and 152*b*, respectively, based on a center 150' of the second connection duct 150, and front portions thereof exposed to the second facing surface 151 have opposite polarities to those of the first and second counter electrodes 152*a* and 152*b*, respectively.

The first and second electrodes 142*a* and 142*b* may be disposed to be bilaterally symmetrical at an upper portion of the first connection duct 140 on the basis of a state where the first and second terminal portions 142 and 152 are located at precise positions. The third and fourth electrodes 142*c* and 142*d* are disposed to be bilaterally symmetrical at a lower portion of the first connection duct 140 on the basis of the state where the first and second terminal portions 142 and 152 are located at precise positions.

In the above example, the third and fourth electrodes 142*c* and 142*d* form the S pole and the N pole, respectively, and the third and fourth counter electrodes 152*c* and 152*d* form the N pole and the S pole, respectively. Accordingly, even though at least one of the first and second connection ducts 140 and 150 is turned and thereby the first and second counter electrodes 152*a* and 152*b* are arranged to correspond to the third and fourth electrodes 142*c* and 142*d* and the third and fourth counter electrodes 152*c* and 152*d* are arranged to correspond to the first and second electrodes 142*a* and 142*b*, the first to fourth electrodes 142*a*, 142*b*, 142*c*, and 142*d* and the first to fourth counter electrodes 152*a*, 152*b*, 152*c*, and 152*d* are not attached as a result of the magnetic repulsive force applied to each other.

As such, the first to fourth electrodes 142*a*, 142*b*, 142*c*, and 142*d* and the first to fourth counter electrodes 152*a*, 152*b*, 152*c*, and 152*d* can be attached to each other by the magnetic forces only when they are arranged at mutually corresponding positions, which may result in preventing the erroneous insertion or reverse insertion between the first and second terminal portions 142 and 152.

Figure 8:
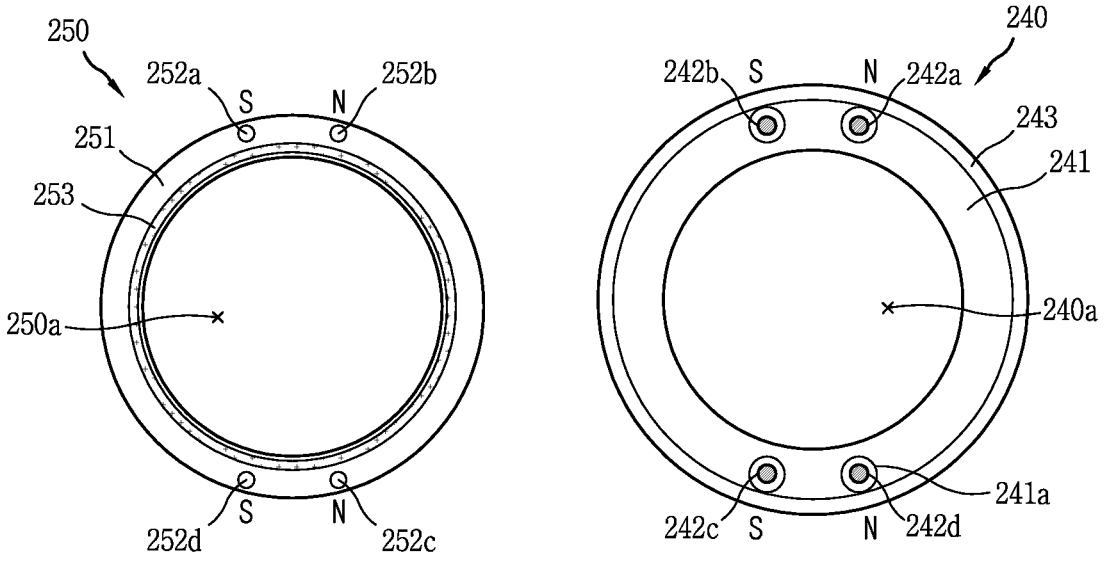
FIG. 8 is a conceptual view illustrating a variation of a sealing structure between the first connection duct and the second connection duct illustrated in FIG. 5.
Figure 9:
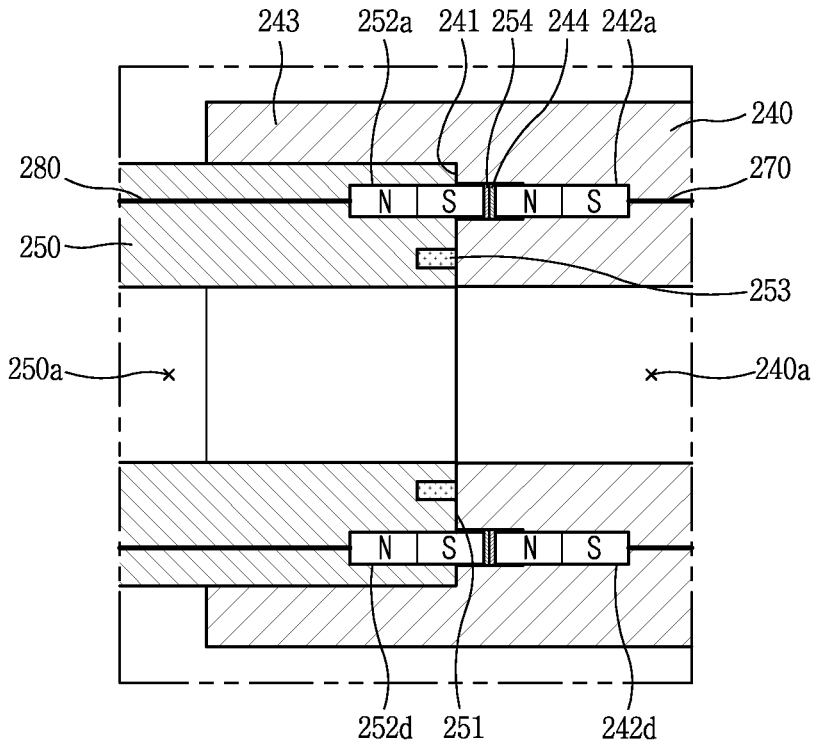
FIG. 9 is a sectional view illustrating a state in which the second connection duct illustrated in FIG. 8 is coupled to the first connection duct.

FIG. 8 is a conceptual view illustrating a variation of a sealing structure between the first connection duct 140 and the second connection duct 150 illustrated in FIG. 5, and FIG. 9 is a sectional view illustrating a state where the second connection duct 150 illustrated in FIG. 8 is coupled to the first connection duct 140.

Referring to FIGS. 8 and 9, a sealing member 253 which surrounds flow paths 240*a* and 250*a* protrudes from one of first and second facing surfaces 241 and 251. The sealing member 253 is closely adhered on another facing surface in a state where first and second terminal portions 242 and 252 are attached to each other.

In the closely-adhered state, the sealing member 253 is formed to surround the flow paths 240*a* and 250*a* of the first and second connection ducts 240 and 250. This may result in preventing leakage of air which flows into the flow path 240*a* of the first connection duct 240 through the flow path 250*a* of the second connection duct 250.

This variation illustrates that the sealing member 253 is disposed on the second facing surface 251 of the second connection duct 250 so as to surround the flow path 250*a*. In the state where the first and second connection ducts 240 and 250 are coupled to each other, the sealing member 253 is closely adhered on the first facing surface 241 and surrounds the flow path 240*a* of the first connection duct 240. The sealing member 253 may be disposed on the first facing surface 241 of the first connection duct 240.

The sealing member 253 may be disposed between the flow paths 240*a* and 250*a* of the first and second connection ducts 240 and 250 and the first and second terminal portions 242 and 252. This variation illustrates that the sealing member 253 is disposed between the flow path 250*a* of the second connection duct 250 and the second terminal portion 252. The sealing member 253 is disposed between the flow path 240*a* of the first connection duct 240 and the first terminal portion 242 in the state where the first and second connection ducts 240 and 250 are coupled to each other.

In this manner, as the sealing member 253 is arranged so as to separate the flow paths 240*a* and 250*a* of the first and second connection ducts 240 and 250 from the first and second terminal portions 242 and 252, dust and foreign materials flowing along the flow paths 240*a* and 250*a* of the first and second connection ducts 240 and 250 can be blocked from flowing into the first and second terminal portions 242 and 252. Therefore, this may result in preventing a defective connection between the first and second terminal portions 242 and 252 due to the introduced dust and foreign materials.

Figure 10:
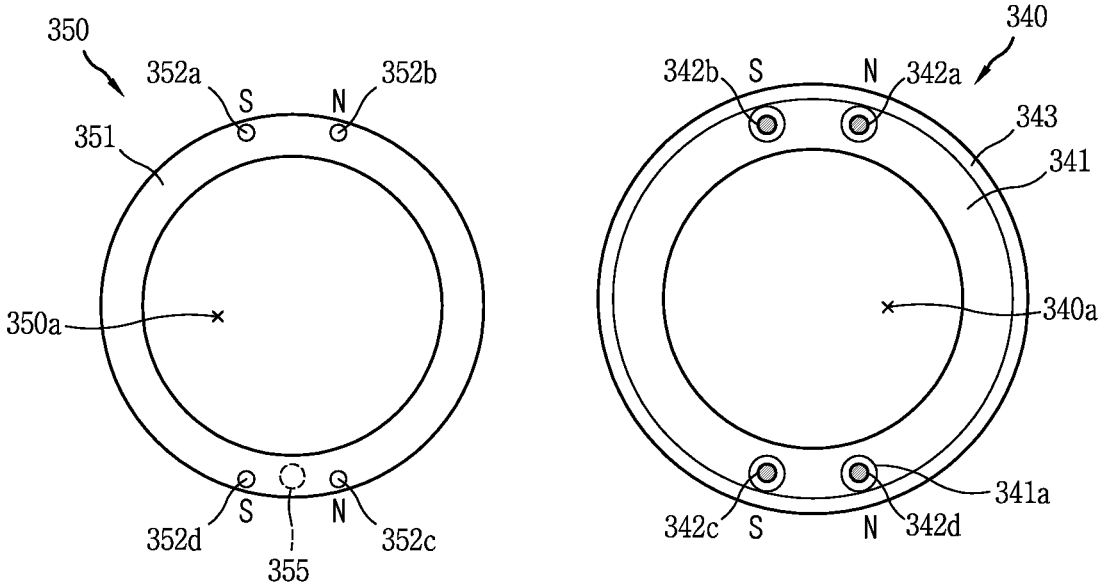
FIGS. 10 to 12 are conceptual views illustrating variations of a structure for attachment at precise positions (in position) between a first terminal portion and a second terminal portion illustrated in FIG. 5.
Figure 11:
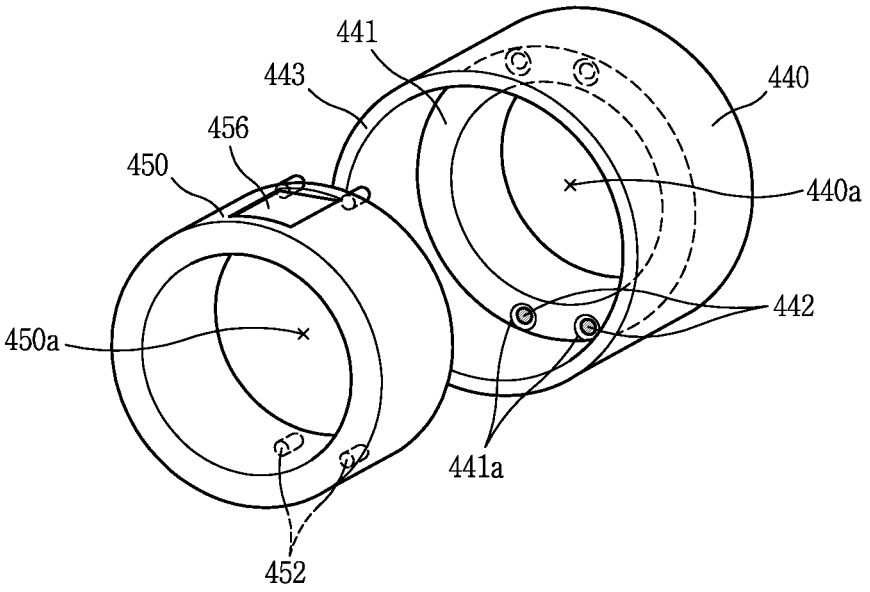
Figure 12:
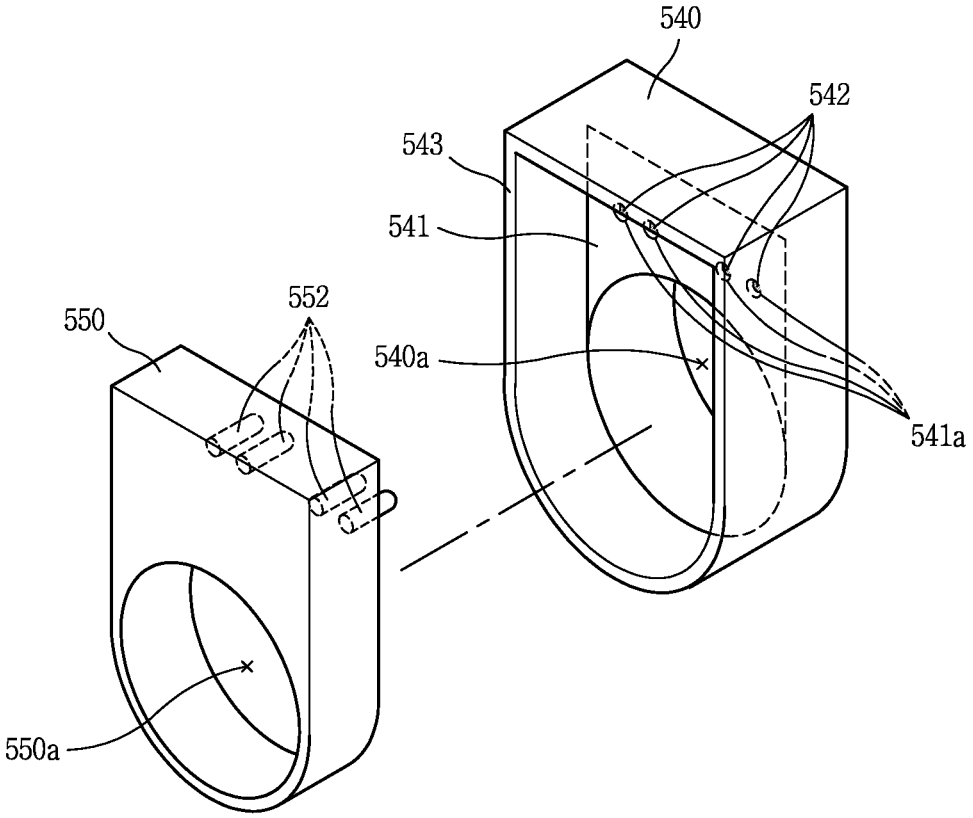

FIGS. 10 to 12 are conceptual views illustrating variations of a structure for attaching the first terminal portion 142 and the second terminal portion 152 illustrated in FIG. 5 in position (in an aligned state with each other).

Referring to FIG. 10, a weight 355 may be provided on a lower portion of a second connection duct 350 on the basis of a state where first and second terminal portions 342 and 352 are located at precise positions (aligned with each other). The weight 355 may be mounted to or inserted into the second connection duct 350. This variation illustrates that the weight 355 is inserted into the second connection duct 350 through insert-injection.

As the weight 355 is provided on the lower portion of the second connection duct 350, the lower portion of the second connection duct 350 where the weight 355 is located may be naturally directed downward when the user connects the second connection duct 350 to the first connection duct 340.

This variation illustrates the second terminal portion 352 in which first and second counter electrodes 352*a* and 352*b* are disposed on an upper portion of the second connection duct 350 and third and fourth counter electrodes 352*c* and 352*d* are disposed on a lower portion of the second connection duct 350. In this case, the weight 355 may be disposed between the third counter electrode 352*c* and the fourth counter electrode 352*d*.

Referring to FIG. 11, a settling groove 456 may be formed on an upper portion of a second connection duct 450 in a state where first and second terminal portions 442 and 452 are located at precise positions (aligned with each other). The settling groove 441*a* may extend along an extending direction of the second connection duct 450.

With the formation of the settling groove 456 on the upper portion of the second connection duct 450, when the user connects the second connection duct 450 to the first connection duct 440, the user can push the second connection duct 450 toward the first connection duct 440 with settling a thumb down on the upper portion of the second connection duct 450 having the settling groove 456. That is, the user can easily recognize the upper portion of the second connection duct 450 by viewing the settling groove 456.

Referring to FIG. 12, as described above, any one of first and second connection ducts 540 and 550 may be accommodated in another one. An accommodating portion 543 of the first connection duct 540 may be formed to be asymmetric in a vertical direction in a structure in which the accommodating portion 543 extends forward from a first facing surface 541 to surround an outer periphery of the second connection duct 550.

For example, the accommodating portion 543 may be formed so that both right and left side surfaces extend perpendicularly from an upper surface and a lower surface has a semicircular shape. A first terminal portion 542 may be formed on an inner upper portion of the accommodating portion 543, and a flow path 540*a* may be formed below the first terminal portion 542.

The first and second connection ducts 540 and 550 can be positioned at predetermined positions by the vertically asymmetric structure of the accommodating portion 543.

Figure 14:
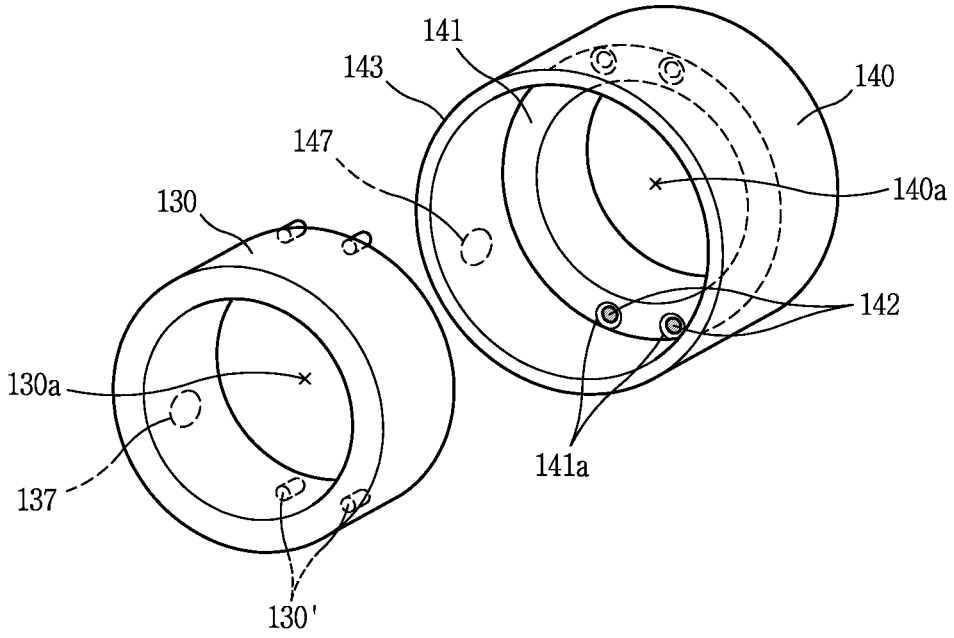
FIG. 14 is an enlarged view of an area A illustrated in FIG. 13.
Figure 15:
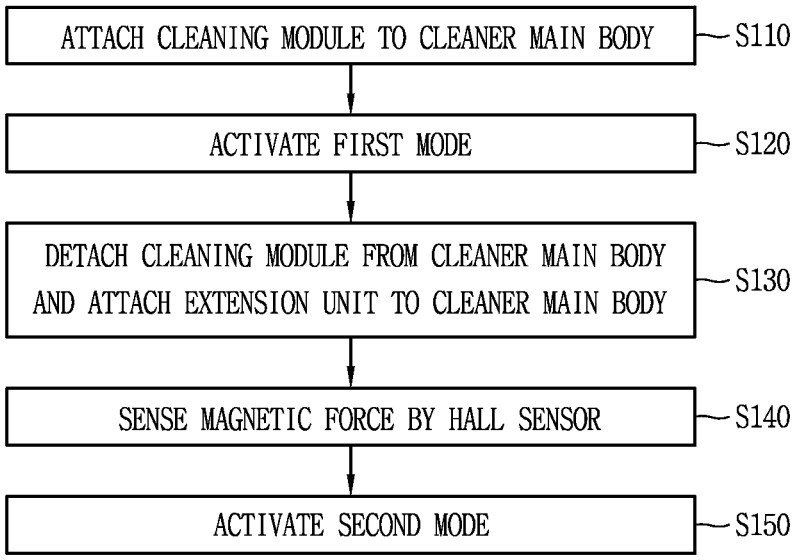
FIG. 15 is a flowchart illustrating a step of switching a cleaning mode when the cleaning module illustrated in FIG. 1 is detached from the cleaner main body and the extension unit illustrated in FIG. 13 is attached on the cleaner main body.

FIG. 13 is a conceptual view illustrating a state in which the cleaning module 120 illustrated in FIG. 1 is detached from the cleaner main body 110 and opposite end portions of the extension unit 130 are connected to the first and second connection ducts 140 and 150, respectively. FIG. 14 is an enlarged view of an area A illustrated in FIG. 13. FIG. 15 is a flowchart illustrating a step of switching a cleaning mode when the cleaning module 120 illustrated in FIG. 1 is detached from the cleaner main body 110 and the extension unit 130 illustrated in FIG. 13 is attached to the cleaner main body 110.

Referring to FIGS. 13 and 14, the extension unit 130 may be coupled to the first connection duct 140 in a state where the second connection duct 150 is separated from the first connection duct 140.

In a state where one end portion of the extension unit 130 is coupled to the first connection duct 140, another end portion of the extension unit 130 may be coupled to the separated second connection duct 150 of the cleaning module 120. That is, opposite end portions of the extension unit 130 are configured to be coupled to the first and second connection ducts 140 and 150.

The extension unit 130 may include a first part 131 coupled to the first connection duct 140, a second part 132 connected to the first part 131 and formed to be flexible, and a third part 133 connected to the second part 132 and coupled to the second connection duct 150. The first and third parts 131 and 133 may be formed of a rigid material (for example, a synthetic resin material). The second part 132 may be configured as a flexible hose. The third part 133 may be provided with a handle 133*a*, and an operating portion (not illustrated) that is operated by the user.

The connection structure of the first and second connection ducts 140 and 150 may be equally applied to at least one of the connection structure between the one end portion of the extension unit 130 and the first connection duct 140, and the connection structure between the other end portion of the extension unit 130 and the second connection duct 150.

For example, as illustrated in FIG. 14, the extension unit 130 (the first part 131 illustrated in FIG. 13) may be detachably coupled to the first connection duct 140 by magnetic force. In the state where the extension unit 130 is attached to the first connection duct 140, a terminal portion 130' of the extension unit 130 may be connected to the terminal portion 142 of the first connection duct 140 and the flow path 140*a* of the first connection duct 140 and a flow path 130*a* of the extension unit 130 may communicate with each other.

As such, the cleaning module 120 of the robot cleaner 100 can be configured to be detachable from the cleaner main body 110 and the extension unit 130 can be connected between the cleaner main body 110 and the cleaning module 120, which may allow the robot cleaner 100 to be configured in different forms according to an assembly type. That is, in the state where the cleaning module 120 is coupled to the cleaner main body 110, the robot cleaner 100 may be configured as a typical robot cleaner 100. On the other hand, in the state where the extension unit 130 is provided between the cleaner main body 110 and the cleaning module 120, the robot cleaner 100 may be configured as a cleaner that can be operated by the user.

According to various embodiments of this disclosure, different cleaning modes may be activated depending on whether the cleaning module 120 is attached to the cleaner main body 110 or the extension unit 130 is attached to the cleaner main body.

To this end, a permanent magnet 137 is provided on the one end portion of the extension unit 130 connected to the first connection duct 140, and a hall sensor 147 for sensing a change in magnetic force due to the permanent magnet 137 is disposed on the first connection duct 140.

The permanent magnet 137 may be mounted to or inserted into the extension unit 130. In an exemplary embodiment of FIG. 14, the permanent magnet 137 may be inserted into the extension unit 130 through insert injection.

The permanent magnet 137 is preferably disposed to be spaced apart from the terminal portion 130' of the extension unit 130 so as to minimize an effect caused by the terminal portion 142 of the first connection duct 140 having magnetism and the proximity of the terminal portion 130' to the hall sensor 147. For example, when the terminal portion 130' of the extension unit 130 is disposed on each of an upper end portion and a lower end portion of the extension unit 130, the permanent magnet 137 may be disposed at a right or left side of the extension unit 130.

The hall sensor 147 is mounted on the first connection duct 140 and is electrically connected to the controller to transmit presence or absence of detected magnetic force due to the permanent magnet 137 to the controller. FIG. 14 illustrates that the hall sensor 147 is mounted in the accommodating portion 143.

The permanent magnet 137 may be disposed to overlap the hall sensor 147 in a state that the terminal portion 130' of the extension unit 130 is connected to the terminal portion 142 of the first connection duct 140 and thus an end portion of the extension unit 130 is accommodated in the accommodating portion 143 of the first connection duct 140.

The controller may activate a different cleaning mode depending on whether or not the magnetic force is detected using the hall sensor 147.

For example, referring to FIG. 15, in a state where the cleaning module 120 is mounted to the cleaner main body 110, magnetic force is not sensed by the hall sensor 147 (S110). The controller may detect this and control the robot cleaner 100 to operate in a first mode (S120). The first mode may be a mode for performing a function of cleaning a floor while traveling on a predetermined area by itself in a completely autonomous travel manner.

In the state where the extension unit 130 is mounted to the cleaner main body 110, the magnetic force due to the permanent magnet 137 is sensed by the hall sensor 147 (S130 and S140). The controller may detect this and control the robot cleaner 100 to operate in a second mode (S150). The second mode may be an automatic driving mode. In the second mode, the sensing unit 112 of the cleaner main body 110 may sense a sensing unit (not illustrated) of the extension unit 130 [or the cleaning module 120 connected thereto] operated by the user. When a distance between the two sensing units is a predetermined distance or more, the controller may move the cleaner main body 110 by driving the driving wheel 111 to reduce the distance.

The foregoing description has been given of the example in which the permanent magnet 137 is provided on the extension unit 130, but the present invention is not limited thereto. The permanent magnet 137 may alternatively be installed on the cleaning module 120. In this case, when the cleaning module 120 is attached to the cleaner main body 110, the magnetic force due to the permanent magnet 137 may be sensed through the hall sensor 147.

As such, when the hall sensor 147 senses the magnetic force due to the permanent magnet 137 provided on the extension unit 130 (or the cleaning module 120) and thus the controller changes the cleaning mode based on the sensed magnetic force, the function of the robot cleaner 100 can be enhanced.

What is claimed is:

1. A robot cleaner, comprising:

a cleaner main body, the cleaner main body including a first connection duct; and a cleaning module, the cleaning module including a second connection duct configured to be detachably coupled to the first connection duct to perform a dust suction function or a mopping function, wherein the first and second connection ducts include a first facing surface and a second facing surface, respectively, the first and second facing surfaces facing each other when the cleaning module is coupled to the cleaner main body, wherein the first and second facing surfaces are each formed in an annular shape surrounding flow paths of the first and second connection ducts, respectively, wherein the first and second facing surfaces include a first terminal portion and a second terminal portion, respectively, the first and second terminal portions being configured to be attached to each other by a magnetic force, wherein the first terminal portion includes a first electrode and a second electrode spaced apart from each other and having front portions exposed to the first facing surface, the front portions of the first and second electrodes having opposite polarities to each other, and wherein the second terminal portion includes a first counter electrode and a second counter electrode arranged to correspond to the first and second electrodes, respectively.

2. The cleaner of claim 1, wherein the flow path of the first connection duct and the flow path of the second connection duct are configured to communicate with each other in a state where the first and second terminal portions are attached to each other.

3. The cleaner of claim 1, wherein the first connection duct further includes an accommodating portion extending forward from the first facing surface and configured to surround an outer circumference of the second connection duct.

4. The cleaner of claim 1, wherein one of the first and second facing surfaces includes a sealing member configured to be closely adhered to the other facing surface in a state where the first and second terminal portions are attached to each other, the sealing member being configured to separate the first and second terminal portions from the flow paths of the first and second connection ducts.

5. The cleaner of claim 1, wherein one of the first and second terminal portions protrudes from one of the first and second facing surfaces, and the other of the first and second facing surfaces includes a recess in which the one terminal portion is inserted, and wherein the other of the first and second terminal portions forms a bottom surface of the recess.

6. The cleaner of claim 1, wherein the first terminal portion further includes a third electrode and a fourth electrode disposed at positions symmetrical to the first and second electrodes with respect to a center of the first connection duct, the third and fourth electrodes having front portions exposed to the first facing surface, and the front portions of the third and fourth electrodes having opposite polarities to the polarities of the first and second electrodes, and wherein the second terminal portion further includes a third counter electrode and a fourth counter electrode disposed at positions symmetrical with the first and second counter electrodes, respectively, with respect to a center of the second connection duct, and the third and fourth counter electrodes having front portions exposed to the second facing surface, and the front portions of the third and fourth counter electrodes having opposite polarities to the polarities of the first and second counter electrodes.

7. The cleaner of claim 6, wherein the second connection duct further includes a weight disposed between the third counter electrode and the fourth counter electrode.

8. The cleaner of claim 1, further comprising an extension unit, the extension unit including opposite end portions connected to the first and second connection ducts, respectively, in a state where the second connection duct is separated from the first connection duct, wherein one end portion of the extension unit connected to the first connection duct includes a permanent magnet, and wherein the first connection duct includes a hall sensor configured to detect a change in magnetic force due to the permanent magnet, and wherein the cleaner main body includes a controller configured to activate a different cleaning mode depending on the presence or absence of a magnetic force detected using the hall sensor.

9. A robot cleaner, comprising:

a cleaner main body, the cleaner main body including a first connection duct defining a first flow path;

a cleaning module, the cleaning module including a second connection duct defining a second flow path and being configured to be detachably coupled to the first connection duct to perform a dust suction function or a mopping function; and an extension unit, the extension unit including opposite end portions connected to the first and second connection ducts, respectively, in a state where the second connection duct is separated from the first connection duct, wherein the second connection duct is configured to be detachably coupled to the first connection duct by a magnetic force, wherein the first connection duct includes a first terminal portion and the second connection duct includes a second terminal portion, the second terminal portion of the second connection duct being connected to the first terminal portion of the first connection duct and the first flow path of the first connection duct and the second flow path of the second connection duct communicating with each other in a state where the second connection duct is attached to the first connection duct, wherein one end portion of the extension unit connected to the first connection duct includes a permanent magnet, and wherein the first connection duct includes a hall sensor configured to detect a change in magnetic force caused by the permanent magnet.

10. The cleaner of claim 9, wherein the first terminal portion and the second terminal portion include externally-exposed front portions configured as magnets having opposite polarities to each other, so as to be attached to each other by a magnetic attractive force when the first and second connection ducts are disposed adjacent to each other.

11. The cleaner of claim 9, wherein the first and second connection ducts include a first facing surface and a second facing surface, respectively, the first and second facing surfaces facing each other when the cleaning module is attached to the cleaner main body, wherein the first and second facing surfaces are each formed in an annular shape to surround the flow paths of the first and second connection ducts, respectively, and wherein the first and second facing surfaces include the first and second terminal portions, respectively.

12. The cleaner of claim 11, wherein the first terminal portion includes a first electrode and a second electrode spaced apart from each other and having front portions exposed to the first facing surface, the front portions of the first and second electrodes having opposite polarities to each other, and wherein the second terminal portion includes a first counter electrode and a second counter electrode arranged to correspond to the first and second electrodes, respectively.

13. A robot cleaner, comprising:

a cleaner main body, the cleaner main body including a first connection duct;

a cleaning module, the cleaning module including a second connection duct and being configured to perform a dust suction function or a mopping function; and an extension unit, wherein opposite end portions of the extension unit are configured to be connected to the first and second connection ducts, respectively, wherein the extension unit is detachably coupled to the first connection duct by a magnetic force, wherein a terminal portion of the extension unit is connected to a terminal portion of the first connection duct and a flow path of the first connection duct and a flow path of the extension unit communicate with each other, in a state where the extension unit is attached to the first connection duct, wherein the first and second connection ducts include a first facing surface and a second facing surface, respectively, the first and second facing surfaces facing each other when the cleaning module is attached to the cleaner main body, wherein the first and second facing surfaces are each formed in an annular shape surrounding the flow paths of the first and second connection ducts, respectively, wherein the first and second facing surfaces include the first and second terminal portions, respectively, wherein the first terminal portion includes a first electrode and a second electrode spaced apart from each other and having front portions exposed to the first facing surface, the front portions of the first and second electrodes having opposite polarities to each other, and wherein the second terminal portion includes a first counter electrode and a second counter electrode arranged to correspond to the first and second electrodes, respectively.

* * * * *